United States Patent [19]

Bockrath

[11] Patent Number: 4,823,143

[45] Date of Patent: Apr. 18, 1989

[54] INTERSECTING SHARED APERTURE ANTENNA REFLECTORS

[75] Inventor: Thomas A. Bockrath, Hawthorne, Calif.

[73] Assignee: Hughes Aircraft Company, Los Angeles, Calif.

[21] Appl. No.: 184,646

[22] Filed: Apr. 22, 1988

[51] Int. Cl.[4] ..... H01Q 19/14

[52] U.S. Cl. ..... 343/781 P; 343/912

[58] Field of Search ..... 343/781 P, 756, 912, 343/779, 835, 836, 909, DIG. 2

[56] References Cited

U.S. PATENT DOCUMENTS

| | | | |
|---|---|---|---|
| 2,522,562 | 9/1950 | Blitz | 343/909 |
| 3,096,519 | 7/1963 | Martin | 343/909 |
| 3,430,246 | 2/1969 | Parquier et al. | 343/756 |
| 3,898,667 | 8/1975 | Raab | 343/756 |
| 4,343,005 | 8/1982 | Han et al. | 343/781 P |
| 4,482,897 | 11/1984 | Dragone et al. | 343/781 P |
| 4,625,214 | 11/1986 | Parekh | 343/756 |
| 4,647,938 | 3/1987 | Roederer et al. | 343/756 |

*Primary Examiner*—William L. Sikes
*Assistant Examiner*—Robert E. Wise
*Attorney, Agent, or Firm*—Mark J. Meltzer; A. W. Karambelas

[57] ABSTRACT

Two reflecting surfaces (102, 104) pass through each other at an intersection line (450) lying in a plane of symmetry (106). The two surfaces share a common aperture (101) and the surface contours of the two surfaces are preferably mirror images of each other and are arranged such that the respective two foci (110, 120) of the two surfaces are equidistant (108) from the center of the shared aperture and offset from each other in equal and opposite directions (**109*a*, 109*b***) from the plane of symmetry.

13 Claims, 3 Drawing Sheets

INTERSECTING SHARED APERTURE ANTENNA REFLECTORS

BACKGROUND OF THE INVENTION

The invention generally pertains to reflector systems for antenna signal transmitting or receiving systems. More particularly, the invention concerns arranging two reflectors in the same shared aperture space for transmitting or receiving signals which are orthogonally polarized with respect to each other.

Conventional energy radiating systems such as antenna systems typically use feed horns to radiate energy off a reflector, typically of parabolic surface contour. Such reflectors are used to collimate or focus the beam of energy for increased radiation efficiency. This arrangement is analogous to a flashlight or searchlight having a reflective curved surface behind the light source itself for increasing the intensity of the output beam.

Energy waves, for example in the radio frequency spectrum, typically are polarized having two orthogonal components—one conventionally termed horizontal the other vertical. Hence it has been possible to broadcast two different signals at the same operating frequency of the radiated energy wherein one signal is derived from the horizontally polarized component and the second signal derived from the vertically polarized component of the energy wave.

In known systems, the two orthogonal components are used to double the information sent at the same frequency by using two separate antennas. The separate antennas generate signals which are orthogonally polarized at the same frequency. In subsequent prior art arrangements, two reflectors for the two antennas were used but placed one behind the other, where the reflectors had grids built into their surfaces such that one reflector would reflect only signals of a first polarity while the other reflector would reflect only signals of the second polarity. In such prior systems, each reflector has its own focal point. The feed horns for the respective polarized signals are located in the vicinity of the focal points, and since such feed horns may not occupy the same physical location, the reflectors necessarily were fashioned of slightly different shapes such that the focal points would not converge along a common focal axis. In known arrangements, the two reflectors would be offset such that the focal axes of the two antennas would be the same, but the focal points would be longitudinally offset along the focal axis. As viewed from the earth, for example, in a satellite communication system carrying the antenna system, the two reflective surfaces in the prior arrangement would be located one behind the other, thus sharing an aperture.

A disadvantage of the prior approach described above is the requirement for increased storage space due to the manner in which the feed systems for the respective orthogonal signals had to be stowed in a spacecraft. Additionally, since the focal points were at differing locations with respect to the center portion of the reflectors, the respective signals were not reflected in an equal manner thereby leading to non-equal performance between the orthogonal pair of polarized signal outputs or inputs. An additional disadvantage of the prior approach is the non-symmetrical arrangement required for the two reflectors resulting in a large variation in total reflector assembly thickness from one edge of the shared aperture to the other. Such large variations in thickness, in turn, lead to problems in stowage of the non-deployed deflector systems in many typical spacecraft having a minimum of available volume for accommodating the reflector system.

SUMMARY OF THE INVENTION

Accordingly, it is an object of the invention to provide a dual reflector shared aperture system for use in collimating beams of information-bearing energy in an assembly structure which is more compact and has improved thermal stability to that of previous designs.

A reflector arrangement for an antenna system includes a first reflector surface having a first focal point and a second reflector surface having a second focal point. The reflector surfaces intersect each other in a way such that the first and second reflector surfaces share a common aperture and the first and second focal points lie on opposite sides of a plane of symmetry passing through the intersection.

BRIEF DESCRIPTION OF THE DRAWING

These and others objects and features of the invention will become apparent from a reading of a detailed description of an illustrative embodiment, taken in conjunction with the drawing, in which.

DETAILED DESCRIPTION

Figure 1A:
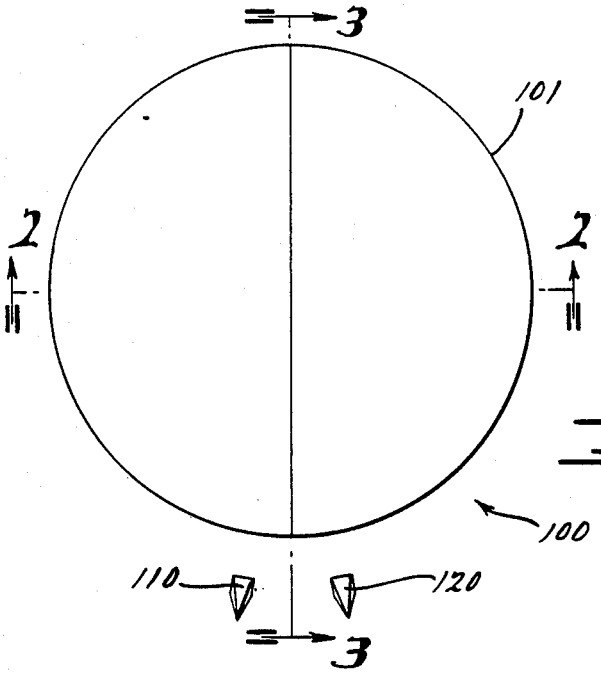
FIGS. 1A, 1B, 1C, and 1D are front, top, isometric and side plan views, respectively, of a pair of intersecting shared aperture antenna reflectors designed in accordance with the principles of the invention.

Various views of a system designed in accordance with the principles of the invention are set forth in the drawing, in which the same component or portion of the depicted arrangement bears like designations in all of the various drawing figures.

The reflector arrangement comprises first and second reflector surfaces 102 and 104 sharing a common projected aperture 101 (FIG. 1A). Reflector surface 102 comprises surfaces **102*a* and 102*b* while reflector surface 104 comprises surfaces 104*a* and 104*b*. The two reflector surfaces of the reflector system 100 intersect along a splice or intersection line 450 which lies in a plane of symmetry, an edge view of which is depicted by the dashed line 106 of FIG. 1B. Each of the surfaces 102 and 104 is substantially parabolic in contour and the two surfaces are preferably substantial mirror images of each other and are positioned about the plane of symmetry such that surface 102 has a focal point at 120 while reflector surface 104 has a focal point at 110. As seen from FIGS. 1A and 1B**, for example, it is to be noted that the feed horns for the respective polarized reflected signals are positioned at the focal points for optimal operation.

Figure 1B:
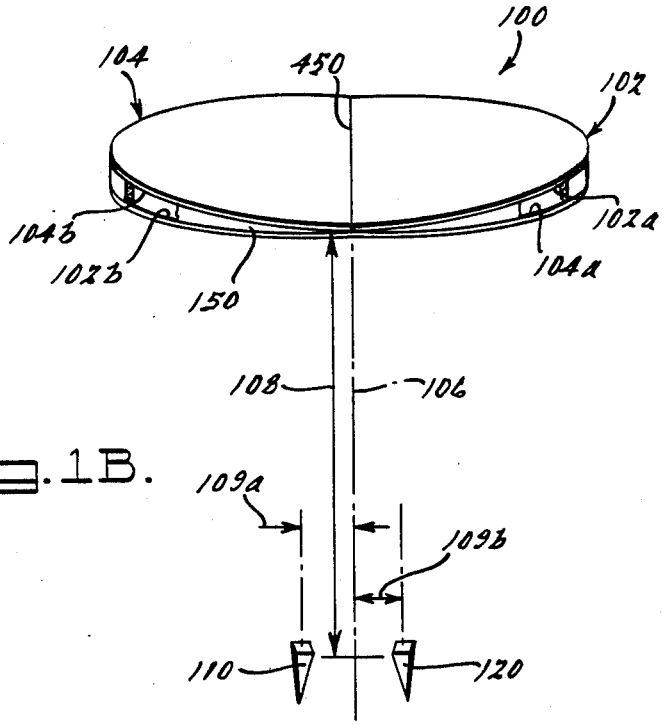
Figure 1C:
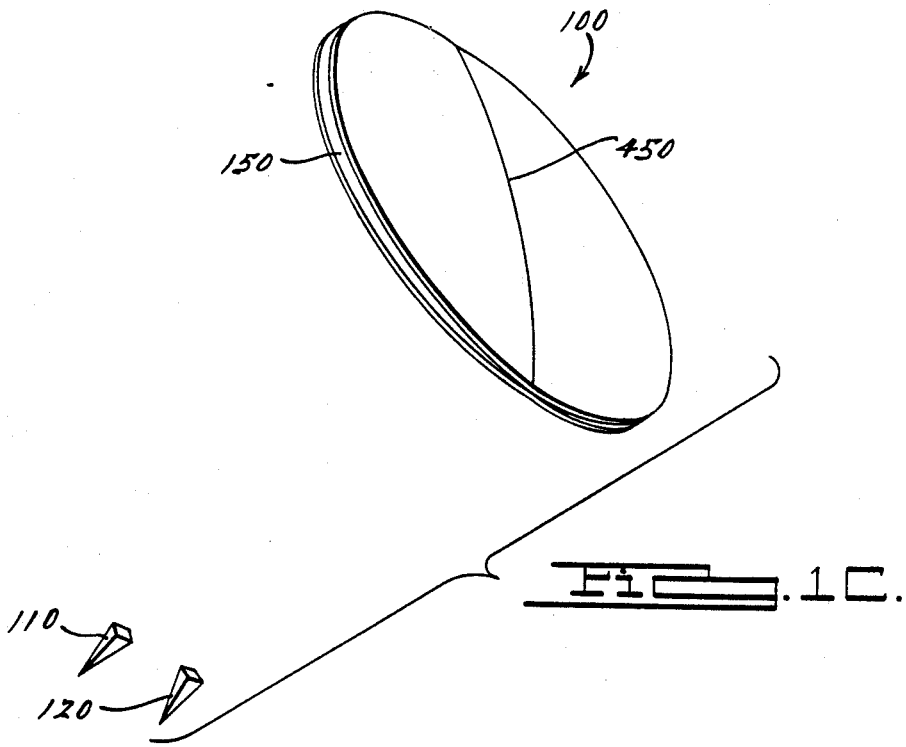
Figure 1D:
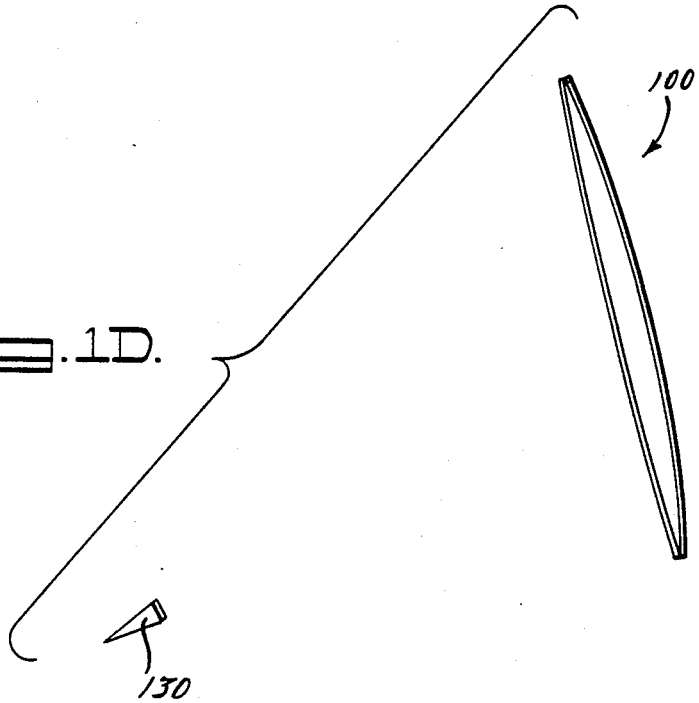

With reference to FIG. 1B, it will be seen therefore that the focal points are located an equal distance 108 along the plane of symmetry 106 from the intersection line of the reflector surfaces 102 and 104, but the horizontal feed and focal point 120 for reflector surface 102 is offset an amount **109*b* from the plane of symmetry while the focal point and vertical feed 110 associated with reflector surface 104 is offset an equal an opposite amount 109***a* in an opposite direction from the plane of symmetry 106.

Figure 2:
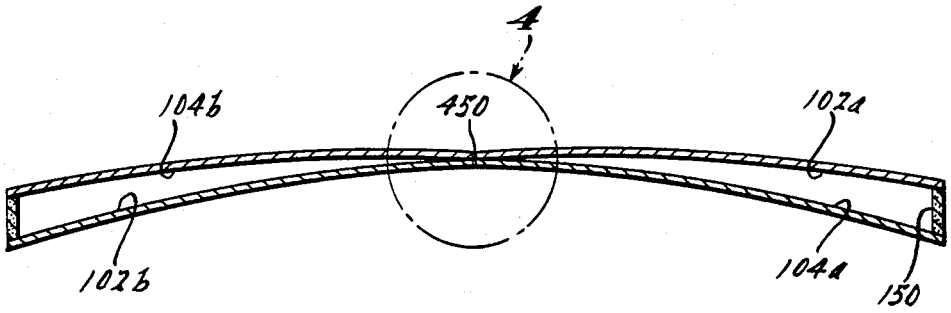
FIG. 2 is a sectional view taken along line 2—2 of FIG. 1.
Figure 4:
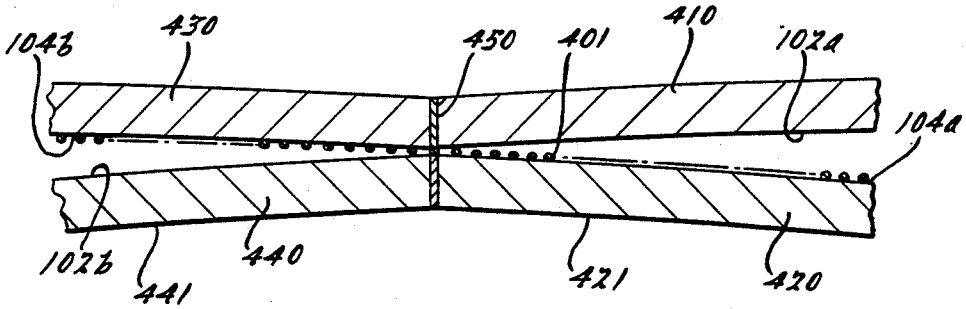
FIG. 4 is a magnified view of the intersection location of the reflectors in the view of FIG. 2.
Figure 3:
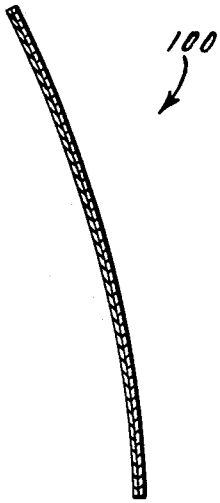
FIG. 3 is a sectional view taken along line 3—3 FIG. 1.

As seen from FIGS. 2 and 4, the reflector assembly is comprised of two reflector surfaces 102 and 104 which form substantially an X-shape in cross section. Each reflector surface is actually formed in two half portions as best seen with reference to FIG. 4. Reflector surface 102 comprises reflector sub-surfaces 102*a* and 102*b* while reflector surface 104 is made up of sub-surfaces 104*a* and 104*b*.

The reflector surface portions are preferably mirror images of each other and are carried on a structure comprised of four shell-like body members 410, 420, 430, and 440 all intersecting at one end thereof at region 450 and extending in pairs in a symmetrical fashion from the common coupling point. Reflector surface portion 102*a* is carried by body member 410 at a surface thereof facing body member 420. The continuation of the reflector surface 102 at 102*b* is carried by body member 440 at a surface thereof facing body member 430. In a similar manner, portion 104*a* of reflector surface 104 is carried on body member 420 at a surface thereof facing body member 410 while surface section 104*b* is carried on body member 430 at a surface thereof facing body member 440.

Each reflector surface is covered with grid line strips so that one surface will reflect energy polarized in a first direction and the second surface will reflect energy polarized in a second direction orthogonal to the first (conventionally termed the horizontal and vertical polarization directions). In FIG. 4, the cross sectional view shows the cross section of a plurality of such grids on surfaces 104*a* and 104*b* while the orthogonal grids on surfaces 102*a* and 102*b* running parallel to the cross sectional view are not visible individually. The grid line strips may, for example, comprise precision etched copper lines mounted on a suitable dialectic carrier. Each gridded surface is transparent to incident energy polarized in a direction orthogonal to the grid for that specific surface. In other words, the surface bearing the horizontal grid is transparent to vertically polarized incident energy, while the surface bearing the vertical grid is transparent to incident energy signals polarized horizontally.

The body members 410, 420, 430, and 440 of the reflector assembly are fashioned, for example, from Kevlar cloth face sheets and Kevlar honeycomb core. These materials are preferred because of their low dialectic constant, light weight and low coefficient of thermal expansion.

Each of the two surface portions of each reflector surface are in the substantially parabolic contour.

The physical arrangement shown optimizes the RF performance of the antenna system. The four individual shells 410 through 440 are jointed at the center of the reflector arrangement in the vicinity of seam 450 by a plurality of Kevlar angle clips and doublers. An outer ring 150 (FIG. 1B) and two external keels (not shown) may be added for strength and stiffness and to minimize thermal distortion.

The intersecting shared aperture dual reflector assembly shown shares the features of prior shared aperture assemblies such as compactness of the reflector assembly leading to easier storage, improved structural stability, necessity for only a single tracking null and the ability to utilize more antennas on a given spacecraft since the antennas may be packaged more compactly.

Additionally, the grids required in a dual surface, shared aperture system improve cross polarization isolation typically in excess of 20dB relative to a solid reflector arrangement. Cross polarization images occur because the incident field of the feed array is not completely orthogonal to the oppositely polarized grid strips in the areas of the reflector surfaces remote from the reflector center. This phenomenon results in some energy being reflected by the oppositely polarized reflector. The image is scanned due to the focal point offset between the front and back reflectors. However, if the focal points are a sufficient distance apart, the image can be scanned to a location outside the service area of the antenna system so as not to degrade system performance.

In addition to a compactness advantage over the prior art, the intersecting shared aperture reflector arrangement offers a further advantage in that the system exhibits improved thermal stability. The intersection region 450 shown for example in FIG. 4 where all four body sections are commonly coupled provides a stable reference from which the surfaces on both reflectors expand and contract due to thermal effects. With the arrangement shown, warpage or eneven thermal expansion or contraction between the two reflector surfaces is prevented. The intersection point 450 near the core splice provides an angle between the two pairs of reflector shells, and this angle does not change with thermal growth of the shells. Since the angle between the shells at the core splice 450 does not change, the observation point from, for example, the earth will not be able to detect the difference if the thermal effects do occur at the reflector system on the spacecraft. This is due to the fact that the reflector surfaces will thermally grow in a manner such that the distance from the observation point to the grid surfaces will not change. Energy waves being sent to or received by the antenna system are therefore not distorted due to differences caused by thermal growth between the two reflectors as could occur in prior art arrangements.

With the reflection surface portions 102*a*, 102*b*, 104*a* and 104*b* arranged as shown in FIG. 4, the reflecting gridded surfaces are able to intersect at as low an angle as desired without in any way adversely effecting the integrity of the joint at 450. Additionally, if the outer face 421 of shell 420 and the outer face 441 of sheel 440 were used to carry gridded reflector surfaces, incident energy signals would not pass through the same amount of dialectic reflector body material on both sides of the splice 450. This would in turn cause the signal on one half of each reflector surface to be out of phase since the dialectic constant of the reflector body material would be different from that for a vacuum. By contrast, with the arrangement of FIG. 4, incident energy always must pass through one thickness dimension of a body member prior to encountering a gridded reflector surface portion, thereby maintaining the reflected signals of a particularly polarized direction in substantially constant phase from one section of the reflector surface to the other.

While in FIGS. 1A, 1B, 1C and 1D single feed horns are shown located substantially at the focal points for the respective reflective surfaces, it is to be understood that a plurality of such feed horns could alternatively be placed at such locations. Additionally, with reference to the view of FIG. 1D, horn 130 is shown in that view as representing a common projection of focal points 110 and 120 in the side view.

The invention has been described with reference to the details of an illustrative embodiment. These details are given for the sake of example only, and the scope and spirit of the invention is to be interpreted by the appended claims.

What is claimed is:

1. A reflector arrangement for an antenna system comprising:

a first reflector surface having a first focal point, a second reflector surface having a second focal point, first and second reflector surfaces intersecting each other at the middle portion thereof and being connected together such that the surfaces are coextensive with each other to share a common projected aperture and so that the surfaces are spaced from each other along their major extend except for their point of intersection; and the first and second focal points lying on opposite sides of a plane of symmetry passing through the intersection of the first and second reflector surfaces.

2. The reflector arrangement of claim 1 wherein the first and second reflector surfaces are substantial mirror images of each other.

3. The reflector arrangement of claim 1 wherein the first and second focal points are positioned equal and opposite distances from the plane of symmetry.

4. The reflector arrangement of claim 3 wherein the first and second focal points are equidistant from a center of the shared aperture.

5. The reflector arrangement of claim 1 wherein the first and second reflector surfaces have substantially parabolic contours.

6. The reflector arrangement of claim 1 wherein the first reflector surface includes a plurality of substantially parallel conductive strips extending in a first predetermined direction, and the second reflector surface includes a plurality of substantially parallel conductive strips extending in a second direction substantially orthogonal to the first direction, such that the first reflector surface will reflect incident energy polarized in the first direction and the second reflector surface will reflect incident energy signals polarized in the second direction.

7. The reflector arrangement of claim 6 wherein the first reflector surface is substantially transparent to energy polarized in the second direction and the second reflector surface is substantially transparent to energy polarized in the first direction.

8. A reflector arrangement for an antenna system comprising:

first, second, third and fourth reflector bodies commonly coupled at a first end thereof in a plane of symmetry, the first and second bodies extending from a first face of the plane of symmetry at a predetermined angle with respect to each other, the third and fourth bodies extending symmetrically to the first and second bodies from an opposite face of the plane of symmetry at the same predetermined angle with respect to each other;

a first reflector surface carried by a first reflector body surface facing the second reflector body and by a fourth reflector body surface facing the third reflector body;

a second reflector surface carried by a second reflector body surface facing the first reflector body and by a third reflector body surface facing the fourth reflector body;

the first and second reflector surfaces intersecting each other along the plane of symmetry and being coextensive with each other such that the surfaces are spaced from each other along their major extent except for their intersection along the plane of symmetry;

wherein the four reflector bodies are positioned such that the first and second reflector surfaces share substantially a common projected aperture and wherein respective focal points of the first and second reflector surfaces lie on opposite sides of the plane of symmetry.

9. The reflector arrangement of claim 8 wherein the first and second focal points are positioned equal and opposite distances from the plane of symmetry.

10. The reflector arrangement of claim 9 wherein the first and second focal points are equidistant from a center of the shared aperture.

11. The reflector arrangement of claim 10 wherein the first and second reflector surfaces have substantially parabolic contours.

12. The reflector arrangement of claim 11 wherein the first reflector surface includes a plurality of substantially parallel conductive strips extending in a first predetermined direction, and the second reflector surface includes a plurality of substantially parallel conductive strips extending in a second direction substantially orthogonal to the first direction such that the first reflector surface will reflect incident energy signals polarized in the first direction and the second reflector surface will reflect incident energy signals polarized in the second direction.

13. The reflector arrangement of claim 12 wherein the first reflector surface is substantially transparent to incident energy polarized in the second direction and the second reflector surface is substantially transparent to incident energy polarized in the first direction.

* * * * *

UNITED STATES PATENT AND TRADEMARK OFFICE

CERTIFICATE OF CORRECTION

PATENT NO. : 4,823,143

DATED : April 18, 1989

INVENTOR(S) : THOMAS A. BOCKRATH

It is certified that error appears in the above-identified patent and that said Letters Patent is hereby corrected as shown below:

Claim 1, col. 5, line 17, "extend" should be --extent--.

Signed and Sealed this

Twelfth Day of June, 1990

*Attest:*

HARRY F. MANBECK, JR.

*Attesting Officer*

*Commissioner of Patents and Trademarks*